United States Patent [19]

Wolf

[11] Patent Number: 4,691,508

[45] Date of Patent: Sep. 8, 1987

[54] SPINNING OR TWISTING MACHINE WITH A DRIVE BELT PERFORMANCE MONITOR

[75] Inventor: Horst Wolf, Albershausen, Fed. Rep. of Germany

[73] Assignee: Zinser Textilmaschinen GmbH, Ebersbach, Fed. Rep. of Germany

[21] Appl. No.: 834,627

[22] Filed: Feb. 27, 1986

[30] Foreign Application Priority Data

Feb. 27, 1985 [DE] Fed. Rep. of Germany ..... 3506822

[51] Int. Cl.[4] ..... D01H 13/14

[52] U.S. Cl. ..... 57/78; 57/105

[58] Field of Search ..... 57/264, 78, 88, 104, 57/105; 474/102, 106; 198/856

[56] References Cited

U.S. PATENT DOCUMENTS

| | | | |
|---|---|---|---|
| 2,071,813 | 2/1937 | Bouton et al. | 198/856 X |
| 2,176,839 | 10/1939 | Gordon | 57/105 |
| 3,662,531 | 5/1972 | Carroll | 57/78 X |
| 3,895,483 | 7/1975 | Grau | 57/264 X |
| 4,051,656 | 10/1977 | Burri et al. | 57/105 |
| 4,242,860 | 1/1981 | Wehde et al. | 57/264 X |
| 4,375,149 | 3/1983 | Hartmannsgruber | 57/78 X |
| 4,481,763 | 11/1984 | Fiedler et al. | 57/264 X |
| 4,566,256 | 1/1986 | Sousek | 198/856 X |
| 4,574,577 | 3/1986 | Derichs et al. | 57/185 X |

FOREIGN PATENT DOCUMENTS

| | | | |
|---|---|---|---|
| 2221296 | 11/1973 | Fed. Rep. of Germany | 198/856 |

*Primary Examiner*—Stuart S. Levy
*Assistant Examiner*—Joseph J. Hail, III
*Attorney, Agent, or Firm*—Karl F. Ross; Herbert Dubno

[57] ABSTRACT

A machine for spinning or twisting yarn comprises a plurality of similar operating units, groups of which are each drivable by a tangential drive belt and a drive having a motor. Each of the tangential drive belts is connected with a drive belt performance observation mechanism, which shuts off the spinning or twisting machine, when the machine senses a deviation from the normal operation of the drive belt. The drive belt performance observation mechanism may also transmit the signal it produces either to a display device or to a sound producing device, so that the machine operator can take further action.

8 Claims, 4 Drawing Figures

SPINNING OR TWISTING MACHINE WITH A DRIVE BELT PERFORMANCE MONITOR

CROSS-REFERENCE TO RELATED APPLICATIONS

The present application is related to the commonly assigned copending application Ser. Nos.: 642,666 filed Aug. 1, 1984, 662,288 filed Sept. 20, 1984 (U.S. Pat. No. 4,635,431), 688,933 filed Jan. 4, 1985 (U.S. Pat. No. 4,592,196), 718,163 filed Apr. 1, 1985 (U.S. Pat. No. 4,617,497), 721,596 filed Apr. 10, 1985 (U.S. Pat. No. 4,627,228), 762,156 filed Aug. 2, 1985 (U.S. Pat. No. 4,612,761), 812,253 filed Dec. 23, 1985 (U.S. Pat No. 4,612,760), 819,541 filed Jan. 16, 1986, 828,838 filed Feb. 12, 1986.

These applications may, in turn, refer to one or more of the following U.S. Pat. Nos.: 4,160,940, 4,359,858, 4,543,519, 4,477,761, 4,518,899, 4,562,388.

FIELD OF THE INVENTION

My present invention relates to a machine for spinning or twisting yarn, and more particularly to a spinning or twisting frame having a sensing and detecting mechanism for drive belt rupture and similar drive belt problems.

BACKGROUND OF THE INVENTION

A machine for spinning or twisting yarn as taught in German Patent application 34 41 230 (see also the abovementioned copending applications) can comprise a plurality of operating units such as spindle whorls (that is, operating elements which rotate at high speed). Groups of these operating units are each drivable by a respective endless tangential drive belt coupled to a drive having a motor. Additionally overlappingly located tangential drive belts generally run around two guide rollers at each end of the respective belt.

By "operating unit" I mean here a machine element with a high rotational speed, for example, a spindle in a spinning or twisting machine or a rotor or a disentangling roller in an open ended spinning machine.

When a tangential drive belt breaks in such machines, under certain circumstances the rupture is not immediately noticed, since the other tangential drive belts generally keep running unchanged. This is particularly true when the belt that breaks is located in the middle of the length of the machine. This kind of belt breaking, for example, in a ring spinning machine, leads immediately to a plurality of yarn breakages, which can overload the yarn suction removal system of the machine. The yarn pieces can no longer be drawn away and wind and tangle on the rollers, which can lead to severe damage to the machine.

OBJECTS OF THE INVENTION

It is an object of my invention to provide an improved spinning or twisting machine which obviates the aforementioned drawbacks.

It is also an object of my invention to provide an improved spinning or twisting frame which allows reaction to a change in drive belt performance.

It is another object of my invention to provide an improved spinning or twisting machine which permits anticipation of operating errors in timely fashion to prevent machine damage.

SUMMARY OF THE INVENTION

These objects and others which will become more readily apparent hereinafter are attained in accordance with my invention in a spinning or twisting machine or frame comprising a plurality of similar operating units, groups of which are each drivable by a respective tangential drive belt coupled to a drive having a motor. Advantageously also two adjacent drive belts may be guided over two common guide roller elements.

According to my invention each of the tangential drive belts is connected with a drive belt performance observation mechanism which shuts off the spinning or twisting machine, when the drive belt observation mechanism senses a deviation from the normal operation of its drive belt.

By deviation from normal operating conditions of the tangential drive belt, I mean here not only breaking of the drive belt, which certainly is a condition which is detected, but also any substantial reduction of the belt tension as a result of which normal operation of the operating units is no longer guaranteed.

In a first embodiment of my invention the drive belt performance observation mechanism senses the presence of the tensioned tangential belt, that is, the presence or absence of the belt tension produces different signals. The drive belt performance observation mechanism can use a variety of phenomena associated with the tangential belt.

It can employ electrooptical light barriers for example which can sense the presence of a broken drive belt or an unbroken drive belt (optical sensors).

It can sense the changes which a tangential drive belt causes in a high frequency oscillating electrical field (capacitor sensors).

It can sense the electrostatic charges, which are generated by a running tangential drive belt in normally unaffected material (electrostatic sensors).

It can sense the air flow, which is generated by a rapidly running tangential drive belt. Of course in all cases it may respond to the absence of a normally present phenomenon.

Mechanical sensing mechanisms have been found to be particularly simple, practical and are considered reliable. Thus the drive belt performance observation mechanism can comprise a pivotable feeler lever contacting the tangential drive belt, which operates a switching mechanism connected to a controller.

In another advantageous embodiment the usually present belt tensioning mechanism forms the sensing mechanism. It is slidable under pressure by a spring and is connected with a sensor which reacts when the tension producing mechanism is slid to an extreme position by the spring on failure of the tangential drive belt.

In another very simple embodiment of my invention in a machine with at least one pressing roller pressing one of the tangential drive belts against the whorls of the operating units by a spring, the spring connected with at least one pressing roller for each tangential drive belt is associated with a sensor which reacts when the pressing roller is pressed into its extreme position by a spring on failure or breaking of the tangential drive belt.

In both of the above cases only an electrical sensor is necessary, which is activated by the tension producing mechanism traveling to its extreme position and/or by the pivotable spring.

Another embodiment of my invention is based on a completely different principle. Here the drive belt performance observation mechanism detects a reduction of the operating power of the drive driving the tangential belt. Both or either of the electrical power demand and also the resulting mechanical power of the drive can be sensed and observed. The resulting mechanical power consumed can be detected by a torque measuring mechanism which, when the power falls below a power which lies under a limiting value not reached during normal operation, generates a signal.

Also in another embodiment the drive belt performance observation mechanism senses whether or not an adjustable minimum limiting value of the electrical input power of the motor has been reached or not. Since the input power (electrical current demand) of a drive motor drops after a drive belt breaks, a limiting power value is provided, which is below the minimum power input of the motor required for normal operation. Since the power consumption of the motor is reduced also in reducing the rotational speed and on stopping the spinning or twisting machine, precautions are required in those cases to prevent the transmission of a broken belt signal and/or to adjust the limiting power value.

It is thus in many cases advantageous when the sensing mechanism senses rapid reductions of the consumed electrical power. Here also only $\Delta N/\Delta t$ is monitored and detected, where $\Delta N$ is a change, particularly in the power consumed, over a time interval $\Delta t$. An adjustment in changed operating conditions is normally needless. It is enough to suppress the signal transmission on stopping the machine.

In further forms of my invention the drive belt performance observation mechanism can be connected by a controller with the drive and/or an alarm or display device. Thus the belt which has been broken is immediately indicated, and the corresponding drive is stopped, while a new tangential drive belt can be put on.

BRIEF DESCRIPTION OF THE DRAWING

The above and other objects, features and advantages of my invention will become more readily apparent from the following highly diagrammatic description, reference being made to the accompanying drawing in which.

SPECIFIC DESCRIPTION

Figure 1:
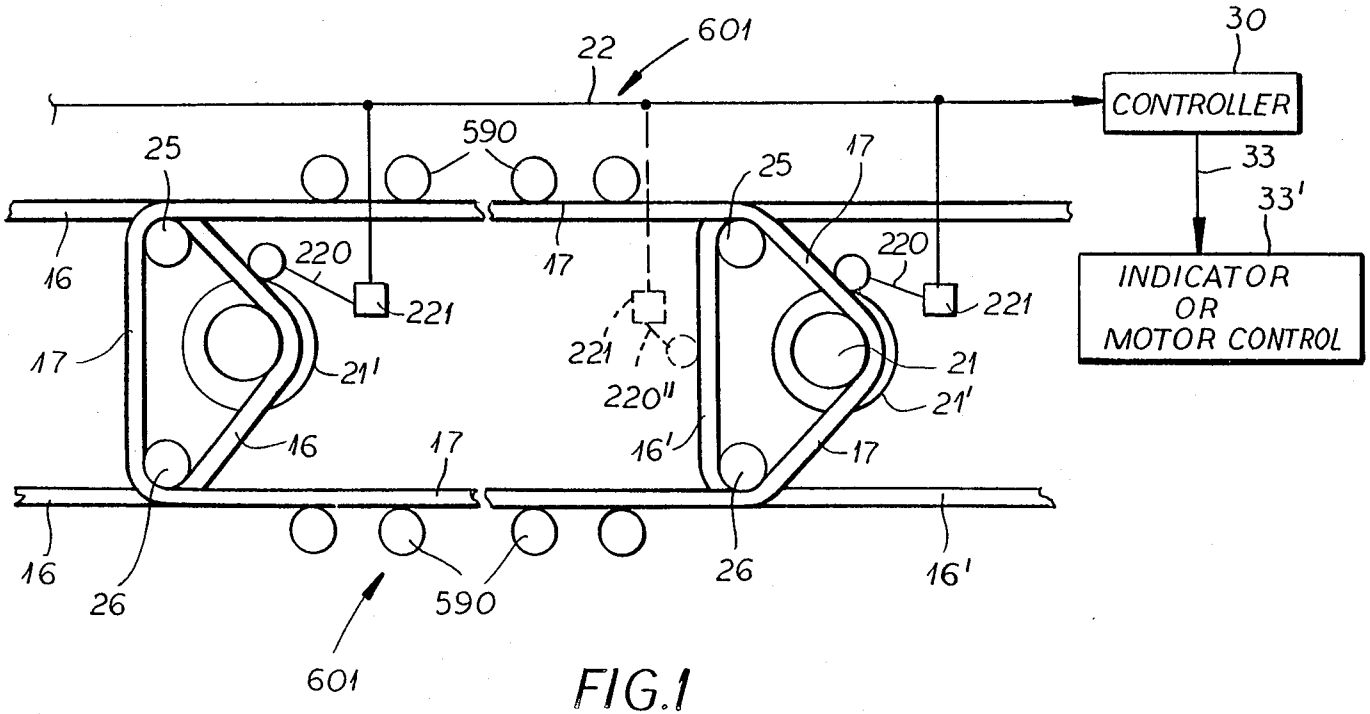
FIG. 1 is a top plan view of a mechanical drive belt performance observation mechanism for a tangential drive belt in the spinning or twisting machine according to my invention.

A cutaway portion of a first embodiment of a ring spinning machine according to my invention, which has a plurality of tangential belts 16, 16', or 17, is shown in FIG. 1. These tangential belts 16, 16' and 17 drive a plurality of operating units 590, in this case spindles 590. Adjacent tangential belts, for example, 16 and 16' run staggered at different heights over guide roller elements 25 and 26 and are driven by drive pulleys 21 mounted on motors 21' in FIG. 1.

A mechanical feeler lever 220 bears against the stretch of the tangential drive belt 16 between the guide roller elements 25 and the drive disk 21, which is connected with an electrical switching mechanism 221.

In case of a break in the tangential drive belt 16 the mechanical feeler lever 220 swings over and the switching mechanism 21 sends a signal to a controller 30 over an electrical conductor 22 connected with it. This signal is analyzed and by a conductor 33 transmitted to an indicating or control unit 33' which calls an operator optically or acoustically and/or to a shut off mechanism which stops the ring spinning machine or the motor associated with the belt failure.

This control mechanism is mounted on each tangential drive belt 16, 16' or 17 of the ring spinning or twisting machine. Another drive belt performance observation mechanism is shown in broken lines in FIG. 1. The feeler lever 220'' also can be mounted on the strand of the tangential belt 16' between the guide roller elements 25 and 26 as is shown in broken lines in the drawing.

Figure 2:
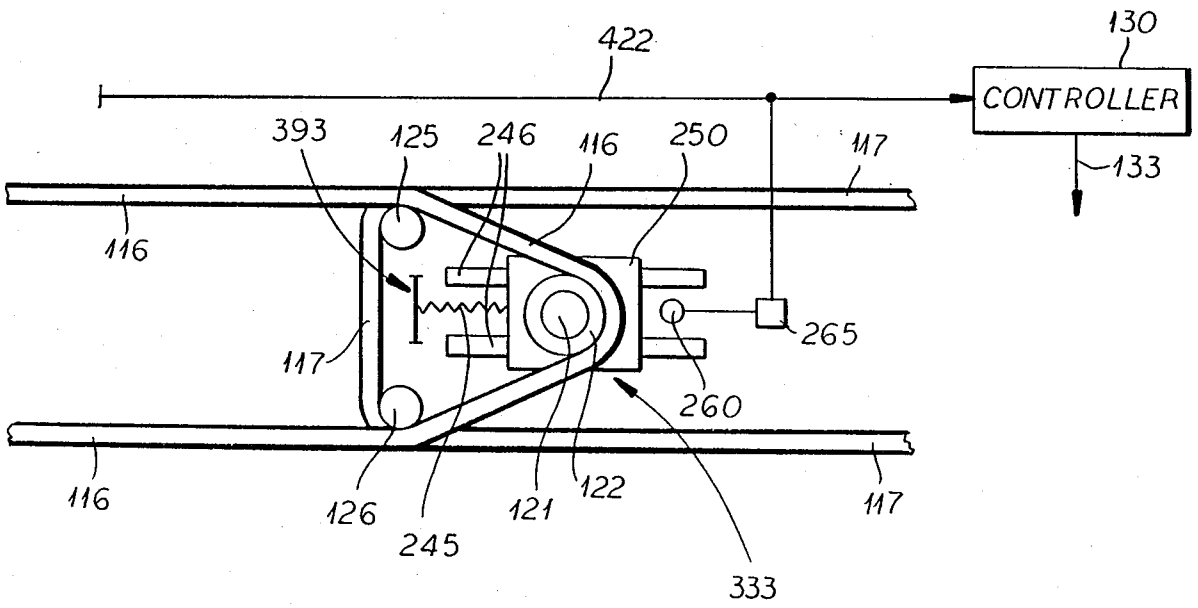
FIG. 2 is a top plan view of another embodiment of a drive belt performance observation mechanism used in the spinning or twisting machine according to my invention.

In the embodiment according to FIG. 2 the tension providing mechanism 393 of the tangential belt serves as the sensing mechanism. The motor 122 of a drive 333 with the drive disk 121 for the tangential drive belt 116 is mounted on sliding carriage 250, which slides on guide rods 246. Sliding carriage 250 is acted on by a spring 245. The sliding carriage 250 and the spring 245 of the tangential drive belt 116 cooperate to provide tension in the tangential drive belt 116.

Should breaking of the tangential drive belt 116 result, the action of the spring 245 slides the carriage 250 to the right and presses it against the sensor 260, which activates an electrical switching mechanism 265 to transmit a signal over the electrical conductor 422 to the controller 130, so that the previously described operation occurs. Similarly in this embodiment the sensing mechanism is provided on each tangential drive belt 116 or 117 of the ring spinning or twisting machine.

Figure 3:
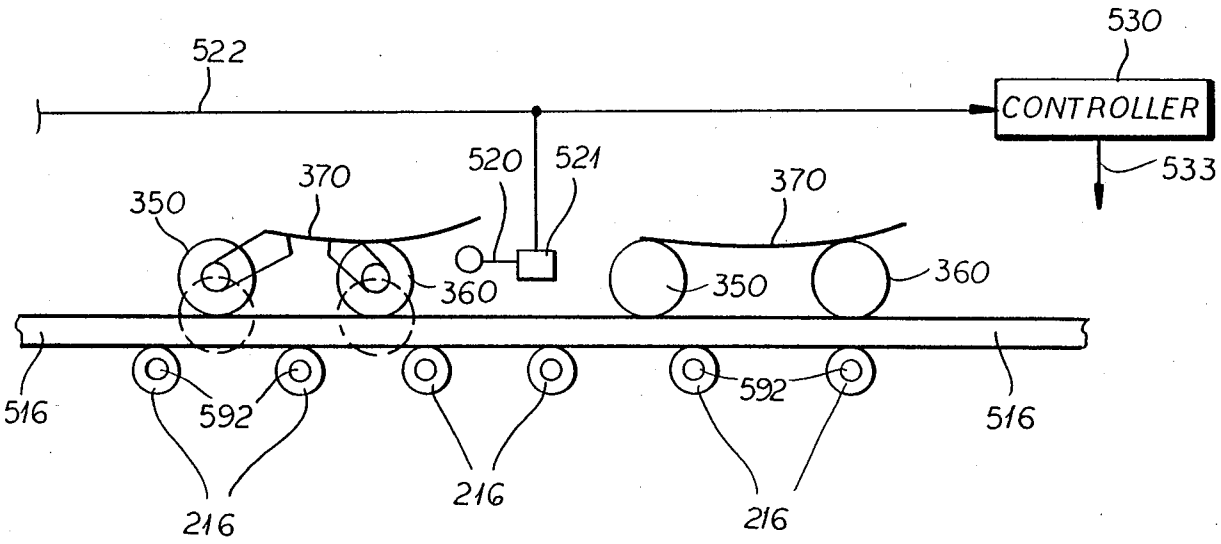
FIG. 3 is a top plan view of a third embodiment of a drive belt performance observation mechanism used in the spinning or twisting machine according to my invention.

FIG. 3 shows how the tangential belt 516 drives the whorls 216 of the spindles 592 of a ring spinning or twisting machine. The tangential belts 516 are pressed by the pressing rollers 350 and 360 against these whorls 216. Both pressing rollers 350 and 360 are slidable under pressure from a spring 370.

On breaking or rupture of the tangential drive belt 516 both pressing rollers 350 and 360 swing into the position shown by the dotted lines. Then the spring 370 acts on the right side of the sensor 520, which may be a feeler lever and which transmits a signal again by activating the electrical switching mechanism 521 to control mechanism 530.

Figure 4:
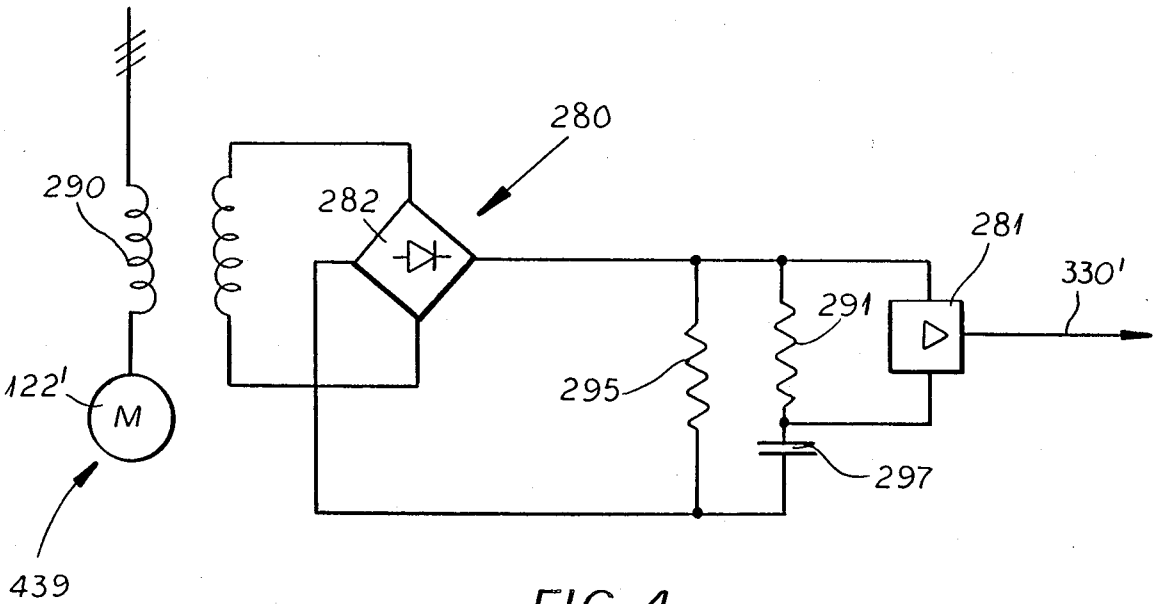
FIG. 4 is an electrical circuit diagram of a final embodiment of an electronic drive belt performance monitoring system of a spinning or twisting machine.

The belt breaking can also be observed and detected by a purely electrical sensing mechanism 280. The circuit diagram for this purely electrical drive belt performance observation mechanism 280 is shown in FIG. 4. In the current feed circuit of the drive motor 122' of drive 439 a current transformer 290 is connected. In the secondary winding of the current transformer 290 a rectifier bridge 282 is connected. This feeds direct current to a capacitor 297, with which a resistance 291 is connected in series. Parallel to this series circuit a high ohmage load resistor 295 is connected. An amplifier 281 is connected across the resistor 291. When a belt breaking occurs, the current flowing in the motor 122' is abruptly reduced. Because of that the voltage across the plate of the condensor 297 is reduced. That voltage is discharged through the bleeder resistor 295 and makes a voltage across the resistor 291. This is amplified in the amplifier 281 and as previously described switches on an alarm signal and/or switches off the machine by transmitting a signal over the conductor 330'. This sensing mechanism operates on a principle of sensing a sudden change in the motor's current.

The operating units (for example 590 in FIG. 1 and 592 in FIG. 3) are divided into groups (601 and 601' in FIG. 1 and FIG. 3) driven by a single drive belt 17 in FIG. 1 and 516 in FIG. 3.

I claim:

1. A textile machine for spinning or twisting yarn, comprising in combination:

a plurality of groups of operating units rotatable for spinning or twisting yarn spaced apart longitudinally along the length of the textile machine, each of said groups of operating units comprising at least one row of rotatable elements tangentially drivable to rotate the respective operating units;

a respective drive belt tangentially engaging each of the rotatable elements of a respective group and a resepctive pair of guide rollers around which said belt passes at each of two opposite ends of the respective row, whereby a plurality of said drive belts each driving only the elements of the respective group are arrayed longitudinally along said machine and between opposite ends of the machine, looping ends of adjacent belts overlapping, each of said belts passing around and engaging the pair of guide rollers about which an adjacent belt passes at each overlap between said belts;

at least one drive motor connected to at least one of said belts and forming a drive means for driving said belts and said machine;

a respective drive-belt-performance-monitoring means for each of said belts for sensing a deviation from normal operation of a drive belt monitored thereby tending to cause yarn breakage in the group of operating units of the row of elements tangentially driven by the monitored drive belt subject to said deviation; and control means responsive to said monitoring means and coupled to said drive means for inactivating said drive means and shutting down said machine upon the detection of said deviation by the respective monitoring means of any of said belts.

2. The textile machine defined in claim 1 wherein said drive belt performance monitoring means includes a respective roller pressing against each belt, and belt-tensing means urging each roller against the respective belt and including a spring adapted to press the respective roller into an extreme position upon breakage of the respective belt, said monitoring means including a sensor reacting to the displacement of said roller into an extreme position for signaling said control means of a deviation from normal operation of the respective belt.

3. The textile machine defined in claim 1 wherein each of said monitoring means includes a roller engaging each belt and pressing the respective belt against at least one of the elements of a row of said elements tangentially engaged by the respective belt, each of said monitoring means further comprising means for generating a signal when the respective roller is pressed into an extreme position by the respective spring means upon breakage of the respective belt.

4. The textile machine defined in claim 1 wherein each of said monitoring means includes means for sensing the power of a respective drive motor drivingly connected to the respective belt and responding to a reduction in the power drawn by the respective motor upon breakage of the respective belt for operating said control means.

5. The textile machine defined in claim 4 wherein said monitoring means each includes means for sensing when an adjustable limiting value of an operating power of the respective motor has been reached.

6. The textile machine defined in claim 4 wherein each of said monitoring means includes means responding to a sudden reduction of operating power for the respective motor signaling said control means of the occurence of a deviation of the respective belt from normal operation.

7. A textile machine for spinning or twisting yarn, comprising in combination:

a plurality of groups of operating units rotatable for spinning or twisting yarn spaced apart longitudinally along the length of the textile machine, each of said groups of operating units comprising at least one row of rotatable elements tangentially drivable to rotate the respective operating units;

a respective drive belt tangentially engaging each of the rotatable elements of a respective group and a respective pair of guide rollers around which said belt passes at each of two opposite ends of the respective row, whereby a plurality of said drive belts each driving only the elements of the respective group are arrayed longitudinally along said machine and between opposite ends of the machine, looping ends of adjacent belts overlapping, each of said belts passing around and engaging the pair of guide rollers about which an adjacent belt passes at each overlap between said belts;

at least one drive motor connected to at least one of said belts and forming a drive means for driving said belts and said machine;

a respective drive-belt-performance monitoring means for each of said belts for sensing a deviation from normal operation of a drive belt monitored thereby tending to cause yarn breakage in the group of operating units of the row of elements tangentially driven by the monitored drive belt subject to said deviation, said monitoring means for each belt including:

a respective sensing lever engaging each of said belts, means for pivotally mounting each lever to swing toward the respective belt, and respective switch means operated by each lever and connected to signal a deviation of the respective belt from normal operation thereof; and control means connected to said switch means of said monitoring means and coupled to said drive means for inactivating said drive means and shutting down said machine upon the detection of said deviation by the respective monitoring means of any of said belts.

8. The textile machine defined in claim 4 wherein said lever is provided with a roller engaging the respective belt and spring means for urging said roller against the respective belt to form a tension-monitoring unit with said roller for said belt.

* * * * *